US006233421B1

(12) United States Patent
Wang et al.

(10) Patent No.: US 6,233,421 B1
(45) Date of Patent: May 15, 2001

(54) DEVELOPER REPLENISHING CONTAINER

(76) Inventors: Jui-Chi Wang; Robin Hsu; Ya-Li Huang; Kuan-Tung Li, all of No. 498, Sec 1, Yung-Shing Rd., Wu-Chi Town, Taichung County (TW)

( * ) Notice: Subject to any disclaimer, the term of this patent is extended or adjusted under 35 U.S.C. 154(b) by 0 days.

(21) Appl. No.: 09/499,001

(22) Filed: Feb. 4, 2000

(51) Int. Cl.[7] ..... G03G 15/08
(52) U.S. Cl. ..... 399/262; 399/262
(58) Field of Search ..... 399/262, 263, 399/260, 250; 222/DIG. 1

(56) References Cited

U.S. PATENT DOCUMENTS 5,296,900 * 3/1994 Saijo et al. ..... 399/260
6,134,411 * 10/2000 Meyer et al. ..... 399/262

FOREIGN PATENT DOCUMENTS 7-20702 * 1/1995 (JP) .
8-62964 * 3/1996 (JP) .

* cited by examiner

*Primary Examiner*—Joan Pendegrass
(74) *Attorney, Agent, or Firm*—Pro-Techtor International Services

(57) ABSTRACT

A developer replenishing container having a cylindrical container body with a bottle neck, and a tapered plug installed in the bottle neck of the cylindrical container body, wherein the tapered plug has a tubular shank axially extended from one end thereof and suspended in the bottle neck and defining with the bottle neck a developer passage for enabling the developer to be smoothly and evenly guided out of the container body through the developer passage upon rotary motion of the container body.

1 Claim, 2 Drawing Sheets

DEVELOPER REPLENISHING CONTAINER

BACKGROUND OF THE INVENTION

The present invention relates to a developer replenishing container for use in a copier, facsimile apparatus, printer or similar electrophotographic image forming apparatus, and more particularly to such a developer replenishing container, which enables the contained developer to be smoothly and evenly supplied.

Various developer replenishing container means for electrophotographic image forming apparatus have been disclosed. Exemplars are seen in U.S. Pat. Nos. 5,455,662; 5,500,719. These developer replenishing container means commonly comprise a cylindrical container body having a spiral guide rib around the inside wall and an opening at one end, a tapered end cap at the opening, and ratchet means at the opening. The cylindrical container body is rotated by a driving mechanism inside the electrophotographic image forming apparatus, causing the contained developer to be delivered out of the opening. This design of developer replenishing container means is still not satisfactory in function. The tapered end cap cannot effectively adjust the output amount of the developer, causing the developer to be supplied unevenly. When the developer is not evenly supplied, a false signal may occur, causing the electrophotographic image forming apparatus to shut down.

SUMMARY OF THE INVENTION

The present invention has been accomplished to provide a developer replenishing container, which eliminates the aforesaid problem. According to one aspect of the present invention, the developer replenishing container comprises a cylindrical container body, the container body having a spiral guide groove on around the inside wall thereof and a bottle neck at one end, and a tapered plug installed in the bottle neck of the cylindrical container body, wherein the tapered plug has a tubular shank axially extended from one end thereof and suspended in the bottle neck and defining with the bottle neck a developer passage for enabling the developer to be smoothly and evenly guided out of the container body through the developer passage upon rotary motion of the container body. According to another aspect of the present invention, the spiral guide groove of the container body has a vertical wall axially extended along one side thereof and facing the bottle neck for stopping backward movement of the developer.

DETAILED DESCRIPTION OF THE PREFERRED EMBODIMENT

Figure 1:
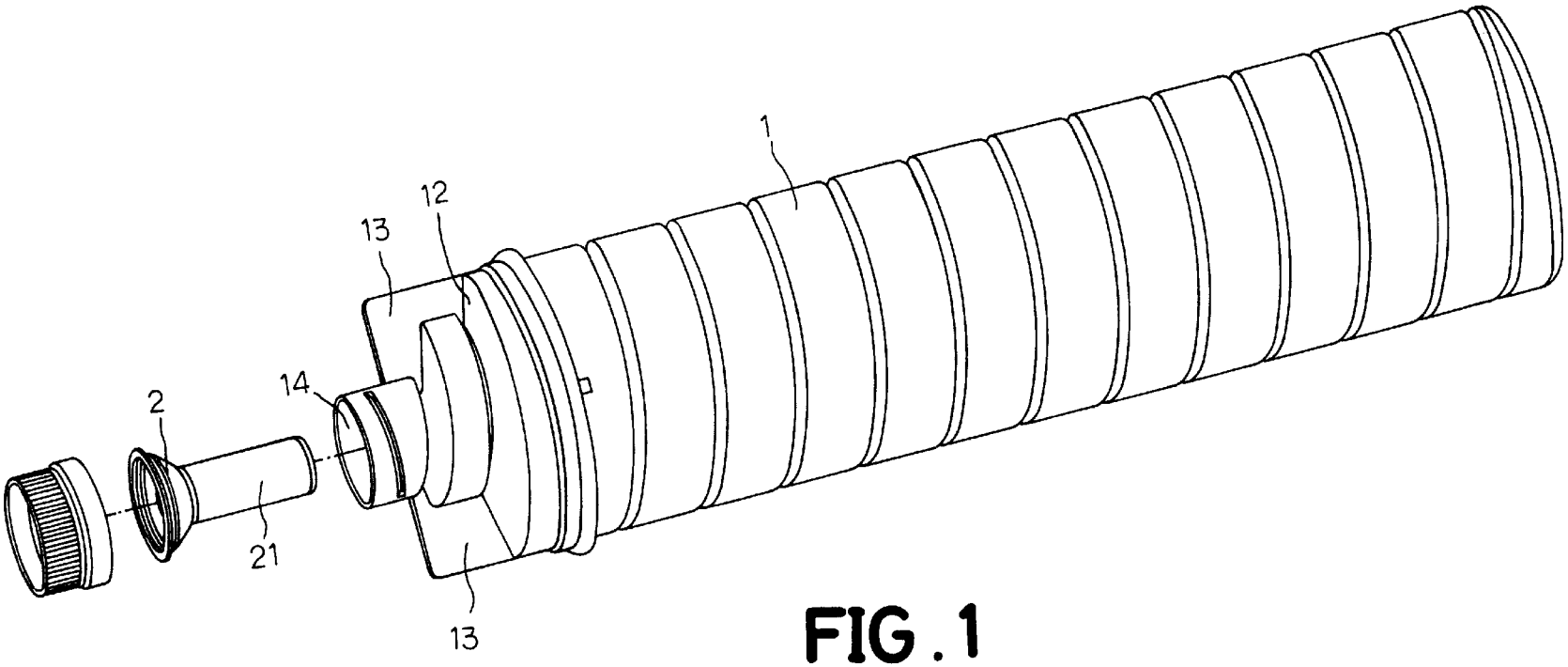
FIG. 1 is an exploded view of a developer replenishing container according to the present invention.
Figure 2:
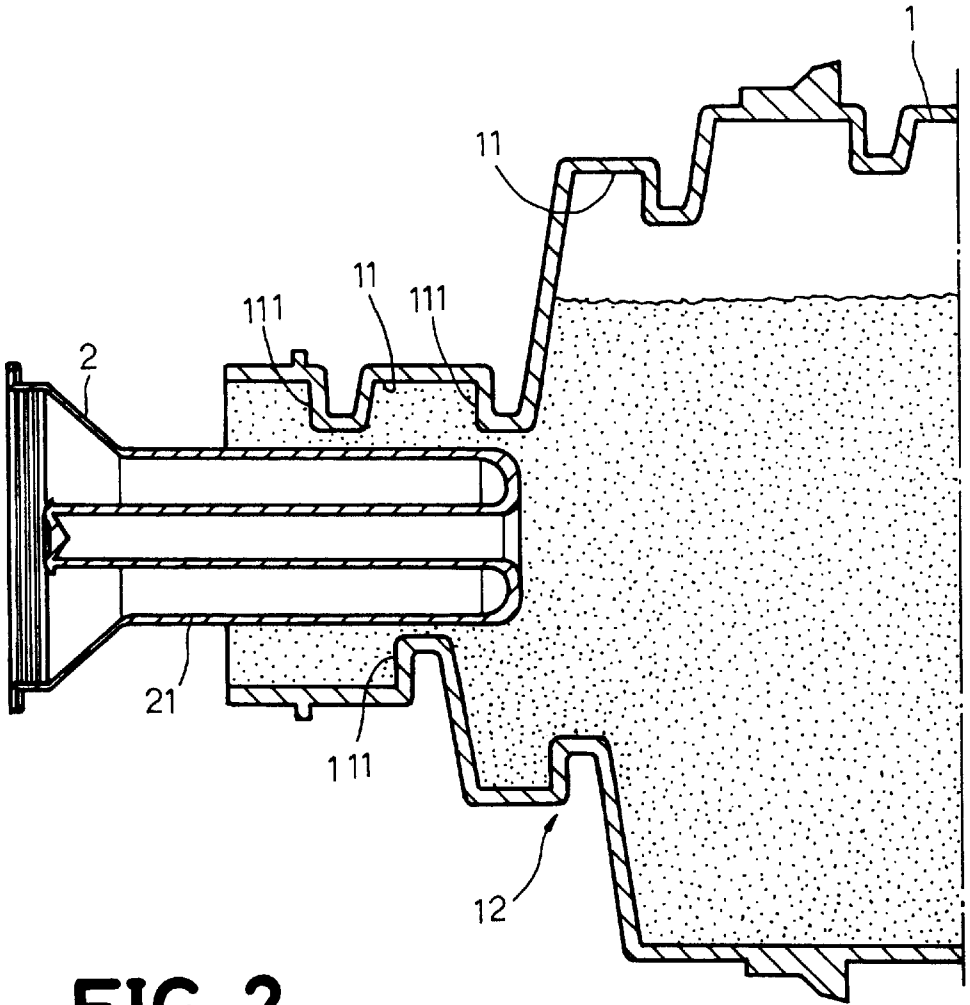
FIG. 2 is a sectional side view in an enlarged scale of the front part of the developer replenishing container according to the present invention.

Referring to FIGS. 1 and 2, a developer replenishing container in accordance with the present invention is generally comprised of a cylindrical container body 1 holding a developer, and a tapered plug 2. The container body 1 has a front end terminating in a tapered shoulder 12 and then a bottle neck 14, and a spiral guide groove 11 spirally disposed around the inside wall thereof. The container body 1 further comprises two positioning flanges 13 formed integral with the bottle neck 14 at two opposite sides. The plug 2 is installed in the bottle neck 14. The spiral guide groove 11 has a vertical wall 111 axially extended along one side thereof and facing the bottle neck 14. The tapered plug 2 has a tubular shank 21 axially extended from one end thereof and suspended in the bottle neck 14.

After installation of the developer replenishing container in an electrophotographic image forming apparatus the positioning flanges 13 are coupled to the transmission mechanism in the electrophotographic image forming apparatus, for enabling the developer replenishing container to be rotated by the transmission mechanism. When the developer replenishing container is rotated in the electrophotographic image forming apparatus, the developer is propelled forwards along the spiral guide groove 11 in the cylindrical container body 1 toward the bottle neck 14, and stopped from backward movement by the vertical wall 111 of the spiral guide groove 11. Because the developer is partially stopped by the plug 2 and propelled forwards during rotary motion of the container body 1, it is smoothly and evenly propelled out of the bottle neck 14 through the gap between the outside wall of the plug 2 and the inside wall of the bottle neck 14.

While only one embodiment of the present invention has been shown and described, it will be understood that various modifications and changes could be made thereunto without departing from the spirit and scope of the invention disclosed.

What the invention claimed is:

1. A developer replenishing container for use with an electrophotographic image forming apparatus, comprising:

a cylindrical container body holding a developer, said container body comprising a tapered shoulder, a bottle neck formed integral with said tapered shoulder at the center for output of said developer, positioning flange means formed integral with said bottle neck on the outside for coupling to driving means in the electrophotographic image forming apparatus with which said developer replenishing container is used, and a spiral guide groove around an inside wall thereof for guiding said developer out of said bottle neck, and a tapered plug installed in said bottle neck; wherein said tapered plug has a tubular shank axially extended from one end thereof and when said tapered plug is inserted into said bottle neck, said tapered plug and said bottle neck define a developer passage for output of said developer; and a side of said spiral guide groove nearest an opening of said bottle neck is an axial wall orthogonal to a longitudinal centerline of said developer replenishing container, said axial wall thereby stopping backward movement of said developer.

* * * * *